US005491619A

United States Patent [19]

Gill

[11] Patent Number: 5,491,619

[45] Date of Patent: Feb. 13, 1996

[54] VIBRATION AND SHOCK ISOLATED HEADLIGHT MOUNTING SYSTEM

[75] Inventor: Avtar S. Gill, Peoria, Ill.

[73] Assignee: Caterpillar Inc., Peoria, Ill.

[21] Appl. No.: 406,436

[22] Filed: Mar. 20, 1995

[51] Int. Cl.[6] ..... F21V 29/00

[52] U.S. Cl. ..... 362/294; 362/306; 362/390; 362/373

[58] Field of Search ..... 362/267, 288, 362/294, 345, 369, 373, 390, 306

[56] References Cited

U.S. PATENT DOCUMENTS

| | | | |
|---|---|---|---|
| 1,786,758 | 12/1930 | Larson | 362/390 |
| 3,145,933 | 8/1964 | Dickson | 362/267 |
| 3,235,721 | 2/1966 | Dickson | 240/8.2 |
| 3,621,232 | 11/1971 | Hough et al. | 240/41.35 R |
| 3,886,349 | 5/1975 | Arai | 240/41 L |
| 4,333,131 | 6/1982 | Hujimoto et al. | 362/372 |
| 4,390,931 | 6/1983 | Gorick et al. | 362/267 |
| 4,446,510 | 5/1984 | Wagner | 362/267 |
| 4,507,712 | 3/1985 | Dolan et al. | 362/61 |
| 4,528,619 | 7/1985 | Dolan et al. | 362/61 |
| 4,570,210 | 2/1986 | Kosmatka | 362/396 |
| 4,740,876 | 4/1988 | Roller | 362/390 |
| 5,335,155 | 8/1994 | Hanson et al. | 362/267 |

*Primary Examiner*—Stephen F. Husar
*Attorney, Agent, or Firm*—Frank L. Hart

[57] ABSTRACT

A headlight of a working machine which is exposed to heavy impact shocks, vibrations, and heat build up has a heat conducting metal element in heat conducting contact with the headlight bulb. The heat conducting metal element is isolated from shock loads and vibration thereby protecting the fragile illuminating element of the light bulb.

3 Claims, 2 Drawing Sheets

VIBRATION AND SHOCK ISOLATED HEADLIGHT MOUNTING SYSTEM

TECHNICAL FIELD

The present invention relates to a mounting system for isolating vibration and shock from the headlight bulb of a headlight of an earthworking or other machine.

BACKGROUND ART

Headlights of vehicles and machines are well known in the art. Various mounting systems have been proposed which protect the headlight bulb from adverse affects of the environment to which they are exposed.

However, in the art of earthworking machines, such as crawler tractors, skidders, loaders, etc., the environment in which they function is extremely severe. The headlight bulbs are very powerful, produce a great deal of heat, and must be sealed from the harsh elements of rain, snow, and ice and protected against the cold and desert type heat while isolating the bulb from extreme shocks and vibrations experience by a working machine.

Heretofore utilized systems for protecting the bulb, the most fragile portion of the headlight, were less than desirably successful.

The present invention is directed to overcome one or more of the problems as set forth above.

DISCLOSURE OF THE INVENTION

Headlights have a housing a reflector, a bulb and a bulb holder. A heat conducting metal element is in intimate heat conducting contact with the bulb holder. The heat conducting metal element extends outwardly from the bulb and has a plurality of spaced apart openings extending therethrough, a silicon rubber grommet is positioned in of the heat conducting metal element openings. Means are provided for connecting each of the grommets to one of the headlight housing and reflector with said heat conducting element being spaced from contact with said housing and reflector.

BEST MODE FOR CARRYING OUT THE INVENTION

Figure 1:
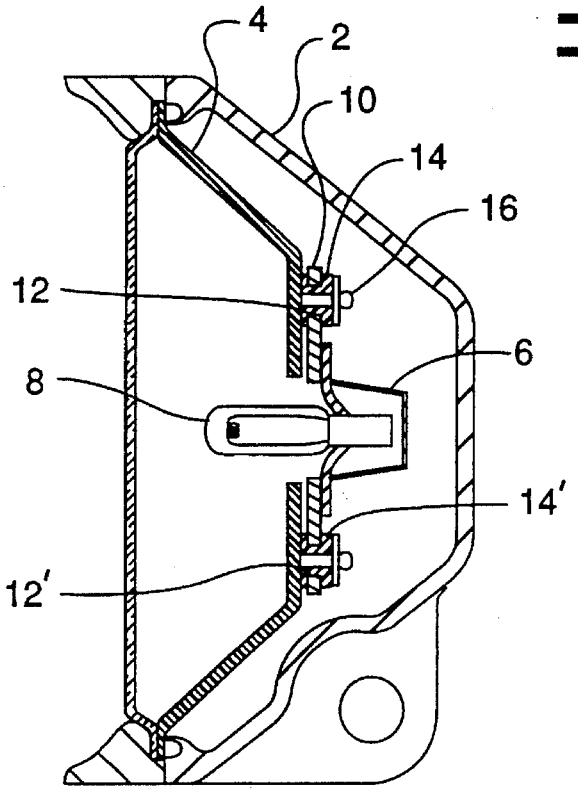
FIG. 1 is a diagrammatic drawing of one embodiment of the headlight system of this invention.
Figure 2:
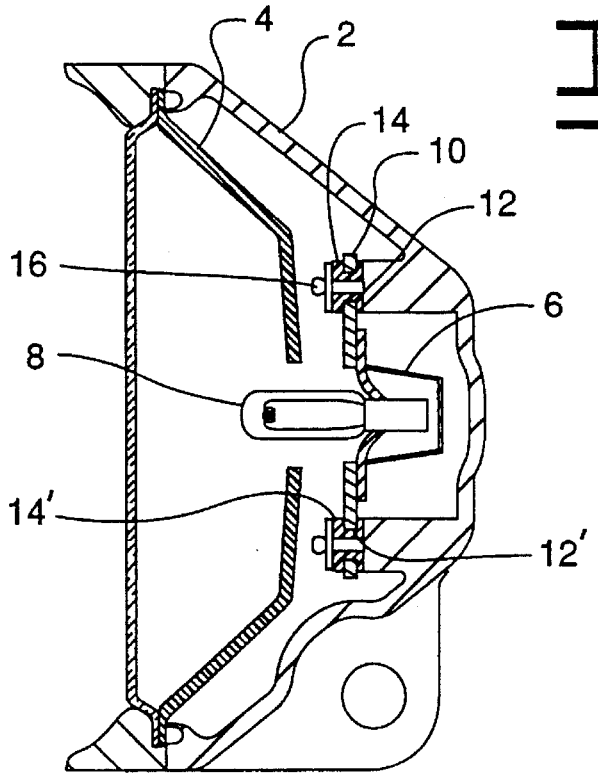
FIG. 2 is a diagrammatic drawing of another embodiment of the headlight system of this invention.
Figure 3:
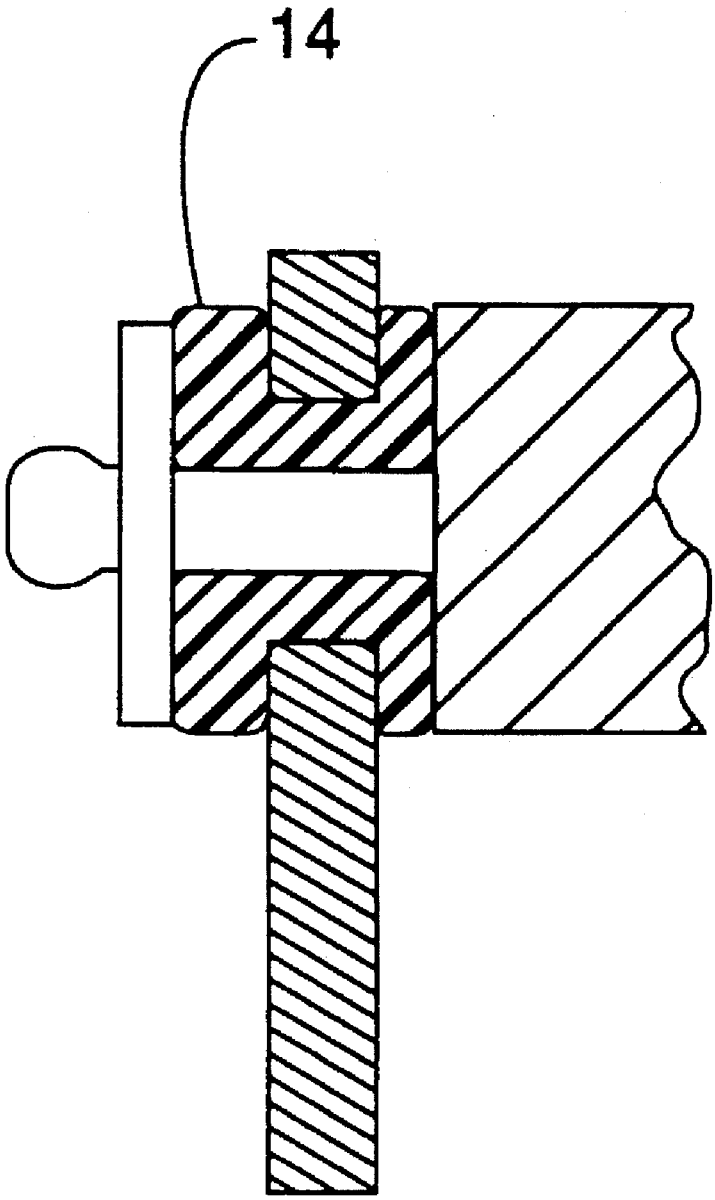
FIG. 3 is a diagrammatic drawing of a preferred connecting means of this invention.

Referring to FIGS. 1 and 2, a headlight of a working machine has a housing 2, a reflector 4, a bulb holder 6, and a bulb 8 as is well known in the art. In the mounting system of this invention, a heat conducting metal element 10 is positioned in intimate heat conducting contact with the bulb holder 6. The heat conducting metal element 10 has a plurality of spaced apart openings 12,12'. Preferably, the openings 12,12', are four in number and are one from the other about the bulb holder 6.

A silicon rubber grommet 14,14', is positioned in each of the heat conducting metal element openings 12,12'. Means are provided for releaseably attaching each of the grommets 14,14', to one of the headlight housing 2 or headlight reflector 4.

Referring to FIGS: 1–3, the connecting means 16 preferably is a plurality of elongated members 18,18' each having one end extending through a respective grommet 14,14' and the other end fixedly attached to one of the housing 2 or reflector 4. Preferably the elongated members 18,18' are posts connected at one end to the housing 2 or reflector 4, as set forth above, with the other end extending through a respective grommet 14,14' and said grommet 14,14' secured thereon by a threaded nut or preferably a "clam shell" nut.

The heat conducting metal element 10 is preferably formed of copper, but can be of other metals which have a high coefficient of thermal conductivity.

INDUSTRIAL APPLICABILITY

By so mounting the heat conducting element 10 via silicon grommets 14,14', the expected severe shock loads and vibrations loads are isolated from the headlight bulb 8 which is the most fragile element of the system. The heat sink/grommet system of this invention also provides an easy to install system which saves labor and materials.

Other aspects, objects and advantages of this invention can be obtained from a study of the drawings, the disclosure and the appended claims.

I claim:

1. In a headlight having a housing, a reflector, a bulb and a bulb holder, the improvement comprising:

a heat conducting metal element in intimate heat conducting contact with the bulb holder and extending outwardly from the bulb, said heat conducting element having a plurality of spaced apart openings extending therethrough;

a silicon rubber grommet positioned in the heat conducting metal element openings; and means for connecting each of the grommets to the reflector with said heat conducting element being spaced from contact with said housing and reflector.

2. A headlight, as set forth in claim 1, wherein the heat conducting metal element extends completely about the bulb and outwardly therefrom.

3. A headlight, as set forth in claim 1, the connecting means is a plurality of elongated members each having one end extending through a respective grommet and the other end fixedly attached to the reflector.

* * * * *